United States Patent [19]

Luetzelschwab

[11] Patent Number: 4,874,248

[45] Date of Patent: Oct. 17, 1989

[54] APPARATUS AND METHOD FOR MIXING A GEL AND LIQUID

[75] Inventor: Wayne E. Luetzelschwab, Littleton, Colo.

[73] Assignee: Marathon Oil Company, Findlay, Ohio

[21] Appl. No.: 225,104

[22] Filed: Jul. 27, 1988

[51] Int. Cl.[4] ..... B01F 7/02

[52] U.S. Cl. ..... 366/307; 366/316

[58] Field of Search ..... 366/302, 307, 303, 304, 366/305, 306, 279, 336, 337, 340, 316; 422/901; 425/200, 202

[56] References Cited

U.S. PATENT DOCUMENTS

| | | | |
|---|---|---|---|
| 2,092,992 | 9/1937 | Thalman | 366/307 |
| 2,169,338 | 8/1939 | Ditto | 366/303 |
| 2,240,841 | 5/1941 | Flynn | 366/307 |
| 2,960,318 | 11/1960 | Caillaud | 366/303 |

*Primary Examiner*—Robert W. Jenkins

*Attorney, Agent, or Firm*—Jack L. Hummel; Rodney F. Brown

[57] ABSTRACT

A low viscosity liquid, such as a monomer, is mixed with a gel, such as a concentrated polymer in gel form. The gel and monomer flow through a cylinder containing spaced rotating discs and stationary discs mounted between the rotating discs. The rotating discs are rotated slowly, at speeds in the range of 10 to 100 rpm, so as not to degrade the polymer. The discs contain a number of apertures through which the gel and liquid flow, breaking the gel down into small particles and increasing the gel surface area exposed to the liquid, thus increasing the rate of diffusion of the low viscosity liquid into the gel.

6 Claims, 3 Drawing Sheets

APPARATUS AND METHOD FOR MIXING A GEL AND LIQUID

FIELD OF THE INVENTION

This invention relates to an apparatus and method for mixing. More particularly, it relates to the mixing of a gel with a low viscosity liquid.

BACKGROUND OF THE INVENTION

Liquids are commonly blended together in mechanical mixers of various designs which subject the liquids to violent agitation. Although this is an effective means for mixing most types of liquids, it is not practical to mix a gel with a liquid in this manner.

In a polymerization system which reacts a thin low viscosity monomer with a thick high viscosity concentrated polymer, it is necessary to obtain a uniform mixture quickly before appreciable reaction takes place. Thus the residence time in the mixer should be short, preferably involving a period of only minutes as opposed to typical mixers in polymerization systems which require a mixing time of tens of minutes or even hours. This is especially critical where polymerization reactants are mixed with recycled polymer in gel form. Care must be taken, however, not to degrade the polymer, which is a danger if the residence time is attempted to be shortened by making the mixing action too violent. Thus on the one hand, to slow the mixing action too much can result in too long a residence time in the mixer, while on the other hand to speed the action through increased agitation can be detrimental to the polymer.

It would therefore be highly desirable to be able to mix a gel with a liquid in a short period of time without degrading the gel.

SUMMARY OF THE INVENTION

This invention provides a method of mixing a gel with a liquid of relatively low viscosity by continuously exposing new surfaces of gel to the liquid by breaking the gel into relatively small particles in the presence of the liquid and maintaining the liquid in intimate contact with the new gel surfaces. By this method the liquid diffuses completely into the gel particles in a relatively short period of time.

In carrying out the method of the invention the gel and liquid are introduced into the inlet of a chamber and are caused to flow downstream in the chamber to an outlet through a plurality of rotating mixing means mounted in the chamber. The rotating mixing means contain spaces through which the gel and liquid flow. The edges which define the spaces break the gel into relatively small particles as they strike the gel, thereby exposing a greater amount of surface area of the gel to the liquid. The particles of gel and the liquid are also caused to flow through spaces in stationary mixing means mounted between the rotating mixing means, this action exposing fresh surface of the gel to the liquid. This action is repeated as often as necessary, thus greatly accelerating the rate of diffusion of the liquid into the gel.

The rotatable mixing means and the stationary mixing means preferably comprise plate means connected to a rotatable shaft extending through a cylinder. In a preferred embodiment the plate means take the form of discs and the spaces through which the liquids flow comprise a number of relatively small apertures. The rotating discs may be rotated quite slowly, in the range of 10 to 100 rpm, which instead of violently agitating or shearing the liquids causes them to be blended in a manner more akin to smearing the low viscosity liquid with the high viscosity liquid. Despite the gentle mixing action, the residence time required in the mixer is only in the order of several minutes, which is ideal for use in a polymerization system utilizing polymer in gel form.

Other features and aspects of the invention, as well as other benefits thereof, will readily be ascertained from the more detailed description of the invention which follows.

DESCRIPTION OF THE PREFERRED EMBODIMENT

Figure 1:
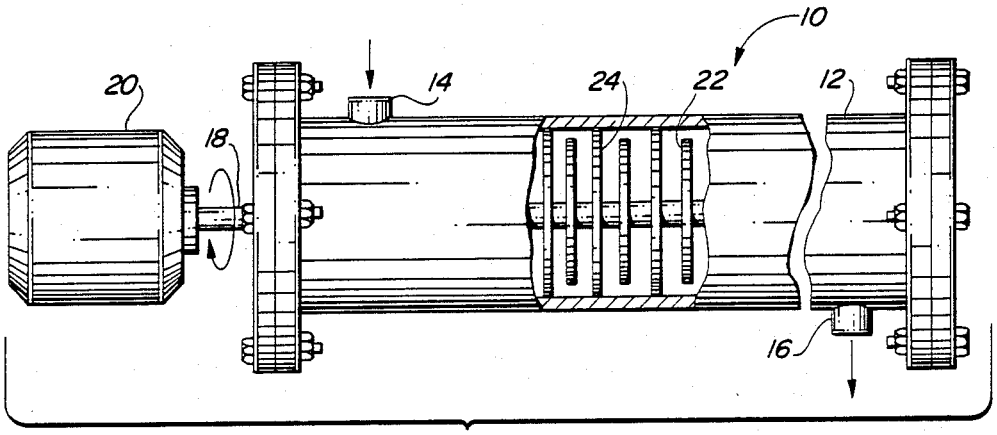
FIG. 1 is a schematic side elevation of the apparatus of the invention, with part of the cylinder broken away to reveal the discs mounted in the interior of the cylinder.
Figure 2:
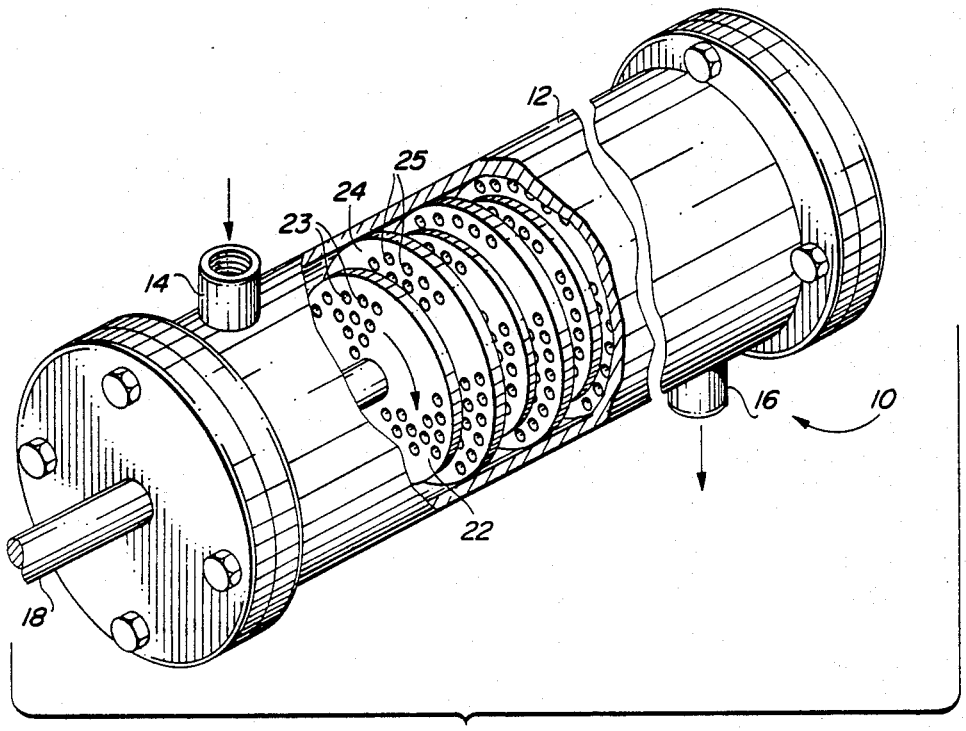
FIG. 2 is a partial pictorial view of the cylinder and discs shown in FIG. 1.

Referring to FIGS. 1 and 2, the mixing apparatus 10 of the present invention comprises a cylinder 12 having inlet and outlet ports 14 and 16 at either end. The ports may be internally threaded to allow them to be conveniently connected to other fluid lines in the system. A shaft 18, connected to a suitable motor 20 for rotation thereby, is rotatably mounted in the cylinder on the longitudinal axis thereof. Connected to the shaft 18 at spaced intervals along its length are discs 22 which rotate with the shaft. Between each pair of discs 22 is a stationary disc 24 which is unconnected to shaft 18 and thus does not rotate with it. Each disc 22 and 24 contains a number of relatively small apertures 23 and 25, respectively, through which liquid and particles of gel flow from one end of the cylinder to the other.

Figure 3:
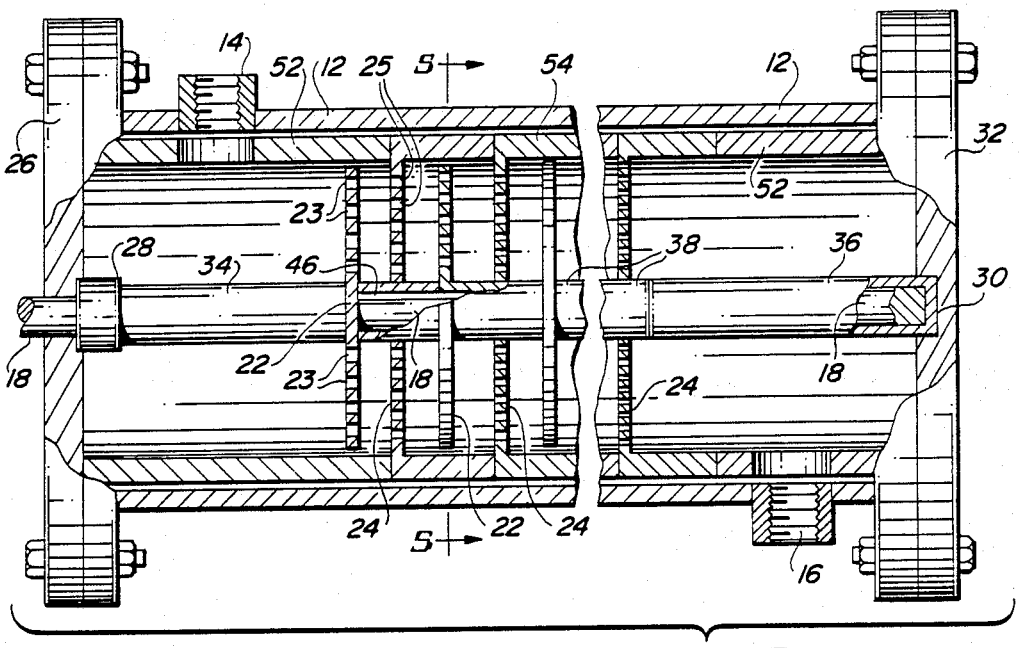
FIG. 3 is a partial side elevation of the apparatus of the invention, with parts being shown in section.
Figure 4:
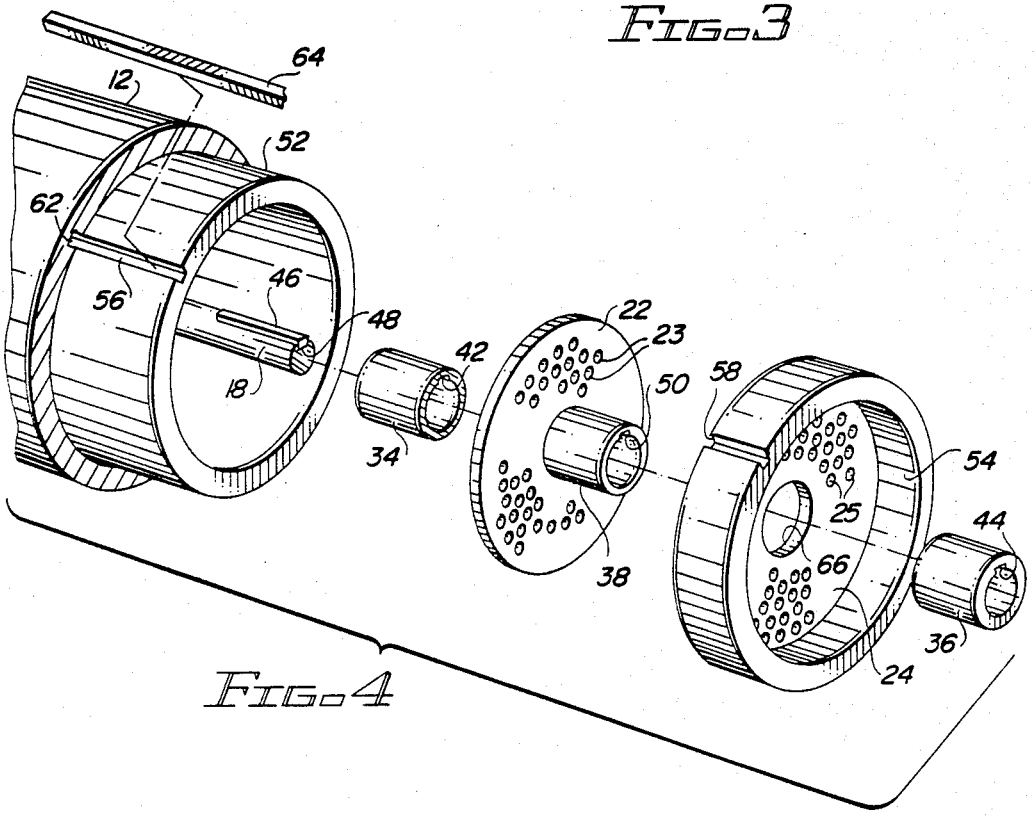
FIG. 4 is a partial exploded pictorial view of the components of the apparatus of the invention.
Figure 5:
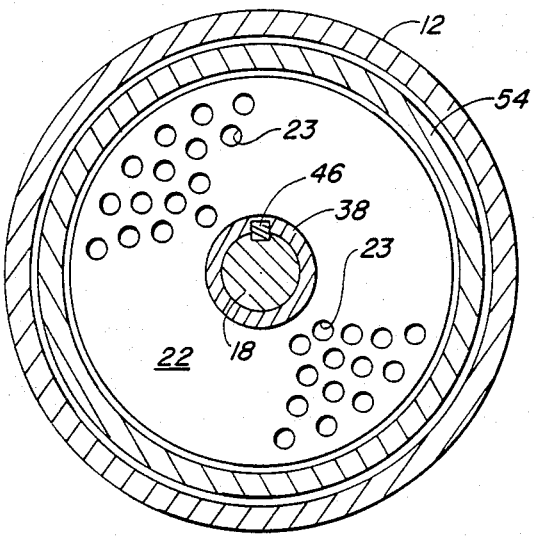
FIG. 5 is a sectional view taken on line 5—5 of FIG. 3.

As shown in FIG. 3, the shaft 18 extends into the cylinder 12 through a bore in upstream end cap 26 and through seal 28, and terminates in a bearing 30 in downstream end cap 32. Short collars or sleeves 34 and 36 are slidably mounted on the upstream and downstream end portions of the shaft to act as end restraints for shaft spacers 38. Each shaft spacer 38 is a short cylinder or sleeve attached by suitable means, as by soldering, to a rotatable disc 22, and the resulting disc and shaft spacer assembly is slidably mounted on the shaft 18. This arrangement is shown in FIGS. 4 and 5 as well as in FIG. 3. It will be understood that the discs 22 contain a central opening the diameter of which is the same as the inside diameter of the spacer 38. The collars 34 and 36 contain keyways 42 and 44, respectively, for receiving a key 46 which fits into the keyways 42 and 44 and into a corresponding keyway 48 in the shaft 18. Similarly, the discs 22 and spacers 38 contain keyways 50 which also receive the key 46. In this manner, the collars 34 and 36 and the disc and shaft spacer assemblies are all connected to the shaft 18 so as to rotate with the shaft 18.

Still referring to FIGS. 3-5, short cylinders 52 are slidably mounted in the end portions of cylinder 12 to act as end restraints for disc spacers 54. Each disc spacer 54 is of the same thickness and radial dimensions as the end restraints 52 except for being much shorter in length, and serves to space and separate the stationary discs 24 from each other. The end restraint cylinders 52, the disc spacers 54 and the stationary discs 24 contain keyways 56 and 58, respectively, at a point on their outer circumference which is not aligned with the inlet 14 or outlet 16. The inside surface of the cylinder 12 contains a corresponding keyway 62, so that a key 64 may fit into the keyways to hold the end restraints 52, the disc spacers 54 and the stationary discs 24 against rotation. The stationary discs 24 are also provided with central openings 66 of a size enabling the discs 24 to be slidably fitted over and supported by the shaft spacers 38. Due to the connection between the stationary discs 24 and the key 64, the stationary discs are prevented from being moved by the rotation of the shaft spacers 38.

Figure 6:
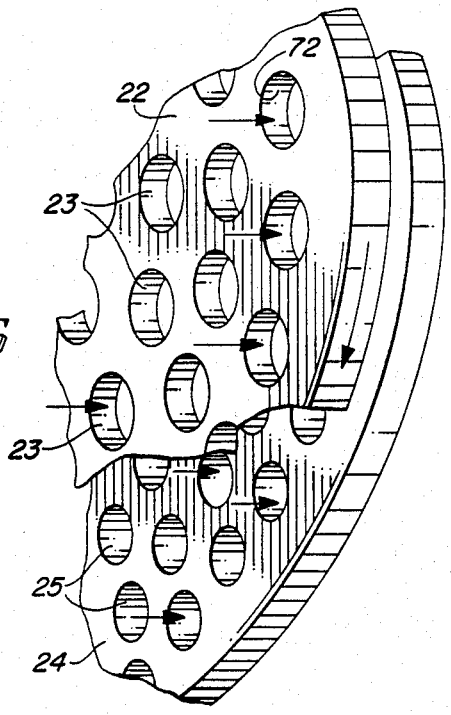
FIG. 6 is an enlarged partial pictorial view of adjacent rotating and stationary discs of the mixer.
Figure 7:
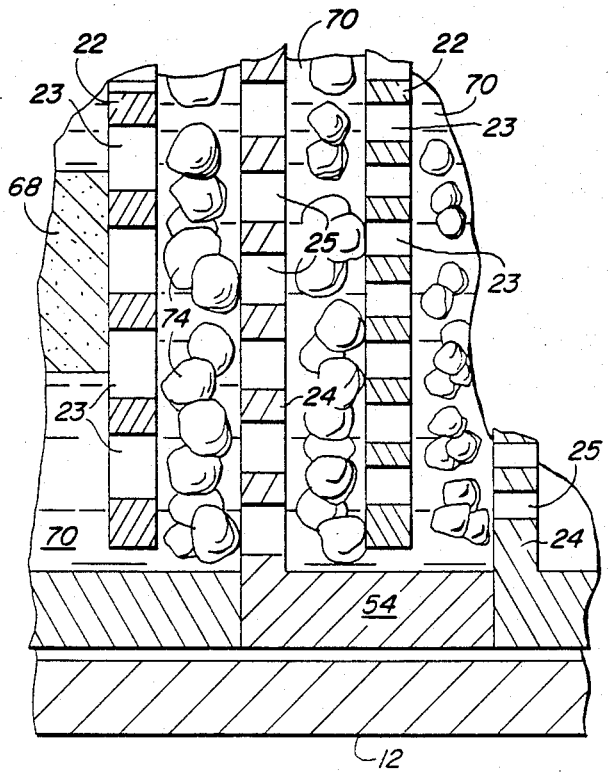
FIG. 7 is an enlarged partial transverse sectional view of the initial rotating and stationary discs of the mixer.

In operation, to mix a gel with a liquid monomer of relatively low viscosity, a polymer gel in dilution water and a low viscosity monomer are introduced into the cylinder 12 through the inlet 14. The motor 20 will be operating to cause the shaft 18 to rotate at a relatively low speed, in the range of only 10 to 100 rpm. As the gel 68 and liquid 70 travel through the cylinder 12 toward the outlet 16, they encounter the first rotating disc 22, best shown in connection with this discussion in FIGS. 6 and 7. A portion of the gel will be aligned with the apertures 23 and will flow directly through them. As the disc 22 and apertures 23 rotate about the shaft 18, the edges 72 of the apertures contact the gel moving through the apertures and break the gel into particles 74. A portion of the gel 68 that does not flow directly through an aperture will first hit the disc 22 until an aperture moves into alignment with it. When this occurs the force of the downstream movement of the liquid streams push the aligned portions of the gel through the apertures. As this movement through the apertures 23 and the relative movement across the face of the disc 22 occurs, the liquid surface area of the gel brought into contact with the liquids is greatly increased, thereby creating conditions which increase the rate of diffusion of the liquids into the gel.

In this connection it should be pointed out that a polymer gel is not simply mixed together with a liquid in order to form a uniform mixture, nor is it simply dissolved in a liquid. Instead, a liquid coming into contact with a mass of gel causes the gel to swell and decrease in concentration, with the liquid maintaining a distinct interface at the gel surface. It has been found that the liquid will initially diffuse relatively rapidly into a fresh polymer gel surface followed, however, by a much slower diffusion rate. The liquid that has diffused into a mass of gel does not penetrate very far over a commercially practical period of time. Thus a mass or large piece of gel will take a very long time to dilute by diffusion alone, but small pieces of gel, such as particles ⅛ inch or less, will dilute within a reasonable period of time by diffusion alone. Further, it has been found that if the small pieces of gel are continually subjected to the impact of the edges of the apertures and the wiping action of the disc as the gel moves along the surface of a disc until it becomes aligned with an aperture, new surfaces of gel are continually exposed to the liquid, and the dilution rate is further increased.

When the liquids and gel reach the stationary disc 24, a portion of the gel particles produced by the rotating disc 22 will move directly through the apertures 25 while the remainder will be forced by the flowing stream and by the transverse currents caused by the rotating discs to move along the face of the disc 24 until they are aligned with an aperture. The transverse component of movement of the gel particles as they pass through the apertures 25 will cause some of the particles to strike the edges of the apertures 25 with sufficient force to cause the particles to break into still smaller particles. By repeating this combination flowing and wiping movement at each of the discs in the mixer, more and more of the gel is exposed to the liquids, allowing rapid diffusion of the liquids into the gel to take place. Complete diffusion will occur by the time the gel reaches the outlet of the chamber. Because of the arrangement of alternate rotating and fixed discs and the low speed of rotation, the shearing forces exerted on the gel are either nonexistent or will have been minimized to the extent that the polymer gel is not degraded.

The dimensions of the mixer components and the number of sets of discs, which will determine the length of the mixer, should be selected so that the mixer is capable of enable complete diffusion of the liquids into the gel to take place. Thus while the specific parameters of the method of diffusion and the specific dimensions of the mixer may change depending upon the particular application, the overall benefits of the invention should be the same.

As to the discs, the spacing between discs is not significant to the dilution process since most of the physical alteration of the gel takes place at the disc itself. The discs should of course not be spaced too close or flow could be restricted. If too far apart the mixer could become too long. The size of the apertures in the discs will have some effect on the spacing because the discs should be spaced apart a distance greater than the size of the particles created by the adjacent upstream disc in order to enable the particles to move.

The number and size of the apertures can vary greatly. Since the gel will enter the chamber of the apparatus as a continuous stream within dilution water, the initial discs encountered should have relatively large apertures in order to begin the particle forming process. The discs which are farther downstream will have smaller apertures which will further reduce the size of the particles in order to expose fresh concentrated gel to the liquid. Thus, mixing apparatus which initially provides gel particles of about 3/16 inch will preferably utilize discs at the downstream end of the mixing chamber which contain apertures adapted to produce 1/16 inch particles. Although there is no hard and fast rule for the amount of open space created in a disc by its apertures, it should be low enough so as not to structurally weaken the disc and great enough to permit low-shear flow of gel in a mixer of reasonable size. A practical range of open space in a disc would thus be about 25% to 85%.

As mentioned previously, the shaft on which the rotatable discs are mounted is rotated at a low speed, in the range of 10 to 100 rpm, which has been found to be sufficient to continuously expose new gel surfaces to the liquid without degrading the polymer gel. The low viscosity liquid would normally have a viscosity in the range of 0.5 to 100 cp, and most commonly in the range of 0.5 to 5 cp, which allows the rapid diffusion into the gel required by the process.

As an example of a specific embodiment, a mixer was designed to utilize forty-five sets of discs in a cylinder, with each spacer being about ½' long and with the distance between a rotating disc and an adjacent stationary disc being about 3/16'. The apertures in the discs were designed to be in the order of 2 to 3 mm, and the distance between apertures in the order of 1 to 2 mm. With such an arrangement the residence time of a polymer gel and a liquid monomer of low viscosity is only a few minutes as compared to the much longer times required by prior art mixers.

It can be seen that the arrangement described permits the mixer to be easily assembled to form a mixer of whatever length is required. The slow speed of rotation requires little power to run the shaft on which the rotating discs are mounted and can be supplied by any suitable economical motor. Although it is preferred that the discs and shaft spacers be formed of stainless steel, the materials of construction need only be strong enough to withstand the stresses to which they are exposed and in addition be able to resist any possible corrosive effects of the liquids flowing through the mixer. Thus the end restraining spacers or collars and the disk spacers may be acrylic, if desired.

It should now be understood that the invention is not necessarily limited to all the specific details described in connection with the preferred embodiment, but that changes to certain features of the preferred embodiment which do not affect the overall basic function and concept of the invention may be made by those skilled in the art without departing from the spirit and scope of the invention, as defined in the appended claims.

What is claimed is:

1. Apparatus for diffusing a liquid of relatively low viscosity into a gel of relatively high viscosity, comprising:

a chamber having an inlet through which a gel and a liquid are introduced into the chamber and an outlet downstream from the inlet through which the diluted gel and liquid are discharged;

a plurality of rotatable discs mounted for rotation in the chamber, the discs containing apertures through which the gel and liquid flow during passage from the inlet to the outlet;

means for rotating the rotatable discs to break the gel into relatively small particles;

the apertures being defined at least in part by edges which break the portions of gel passing through the apertures into smaller particles; and stationary plates mounted between the rotatable discs, the stationary plates containing apertures through which the gel and liquid flow during passage between adjacent rotating discs;

the apertures in the rotatable discs and stationary plates being larger in discs and plates located nearer the inlet than in discs and plates located nearer the outlet;

whereby the gel is continuously subjected to forces tending to break the gel particles down to smaller size, thereby substantially increasing the amount of surface area of the gel exposed to the liquid to greatly accelerate the diffusion of the relatively low viscosity liquid into the gel.

2. Apparatus according to claim 1, wherein the edges of the apertures in the discs and plates extend substantially at right angles to the faces of the discs and plates.

3. Apparatus according to claim 2, wherein the apertures comprise circular openings having diameters in the approximate range of 2–3 mm and being spaced apart a distance in the approximate range of 1–2 mm.

4. A method of diffusing a liquid of relatively low viscosity into a gel of relatively high viscosity in a chamber having an inlet and an outlet downstream therefrom, comprising the steps of:

introducing a gel having a relatively high viscosity and a liquid having a relatively low viscosity into the chamber through the inlet thereof;

causing the gel and liquid to flow downstream to the outlet through a plurality of rotating mixing means, the rotating mixing means having relatively small openings therein at least partially defined by edges which break the gel into relatively small particles, the gel particles and liquid passing through the openings; and causing the gel particles and liquid to flow through stationary mixing means mounted between the rotating mixing means, the stationary mixing means having relatively small openings therein through which the gel particles and liquid flow;

whereby the amount of surface area of the gel exposed to the liquid is significantly increased and new surfaces of gel are continuously exposed to the liquid to greatly accelerate the diffusion of the relatively low viscosity liquid into the gel.

5. A method according to claim 4, wherein the rotating mixing means are rotated at a speed in the range of 10 to 100 rpm and the viscosity of the liquid is in the range of 0.5 to 100 cp.

6. A method according to claim 4, wherein the gel is a recycled polymer and the liquid is a monomer feed to a polymerization reactor.

* * * * *

UNITED STATES PATENT AND TRADEMARK OFFICE

CERTIFICATE OF CORRECTION

PATENT NO. : 4,874,248

DATED : October 17, 1989

INVENTOR(S) : Wayne E. Luetzelschwab

It is certified that error appears in the above-identified patent and that said Letters Patent is hereby corrected as shown below:

| | |
|---|---|
| Col. 1, line 59: | Delete "surface" and insert --surfaces--. |
| Col. 5, line 6: | After "1/2", delete " ' " and insert --"--. |
| Col. 5, line 8: | After "3/16", delete " ' " and insert --"--. |

Signed and Sealed this

Twenty-eighth Day of August, 1990

*Attest:*

HARRY F. MANBECK, JR.

*Attesting Officer*

*Commissioner of Patents and Trademarks*